US005108124A

United States Patent [19]

Pascal et al.

[11] Patent Number: 5,108,124

[45] Date of Patent: * Apr. 28, 1992

[54] SKI HAVING IMPROVED SLIDING AND GRIPPING PROPERTIES

[75] Inventors: Roger Pascal, Annecy le Vieux; Gilles Recher, Marc en Barevil and Jean-Luc Diard, Annecy le Vieux, all of France

[73] Assignee: Salomon S.A., Annecy Cedex, France

[ * ] Notice: The portion of the term of this patent subsequent to Jun. 13, 2006 has been disclaimed.

[21] Appl. No.: 548,204

[22] Filed: Jul. 5, 1990

Related U.S. Application Data

[63] Continuation of Ser. No. 432,394, Nov. 6, 1989, abandoned, which is a continuation of Ser. No. 157,467, Feb. 18, 1988, abandoned, and a continuation-in-part of Ser. No. 49,933, May 15, 1987, Pat. No. 4,838,572.

[30] Foreign Application Priority Data

Feb. 27, 1987 [FR] France ..... 87 03116

[51] Int. Cl.[5] ..... A63C 5/04

[52] U.S. Cl. ..... 280/609

[58] Field of Search ..... 280/602, 608, 609, 610

[56] References Cited

U.S. PATENT DOCUMENTS

| | | | |
|---|---|---|---|
| Re. 29,659 | 6/1978 | Bildner | 280/608 |
| 2,695,175 | 11/1954 | Rheinfrank, Jr. | 280/610 |
| 3,095,207 | 6/1963 | Head | 280/608 |
| 3,272,522 | 6/1965 | Kennedy, III | 280/609 |
| 3,416,810 | 12/1968 | Kennedy | 280/609 |
| 3,762,734 | 10/1973 | Vogel | 280/609 |
| 4,005,875 | 2/1977 | Bjertnaes | 280/610 |
| 4,261,778 | 4/1981 | Albrigtsen et al. | 280/610 |
| 4,433,855 | 2/1984 | Wyke | 280/609 |
| 4,697,821 | 10/1987 | Hayashi et al. | 280/609 |
| 4,961,592 | 10/1990 | Diard et al. | 280/609 |

FOREIGN PATENT DOCUMENTS

| | | |
|---|---|---|
| 1958349 | 5/1971 | Fed. Rep. of Germany . |
| 2461890 | 10/1976 | Fed. Rep. of Germany . |
| 3308599 | 9/1983 | Fed. Rep. of Germany . |
| 3441058 | 5/1986 | Fed. Rep. of Germany . |
| 0985174 | 7/1951 | France . |
| 1124600 | 10/1956 | France . |
| 1343014 | 10/1963 | France . |
| 2069824 | 9/1971 | France . |
| 2097849 | 3/1972 | France . |
| 2509185 | 1/1983 | France . |
| 2517548 | 6/1983 | France . |
| 2522976 | 9/1983 | France . |
| 2559673 | 8/1985 | France . |
| 43-24330 | 10/1968 | Japan . |
| 0585055 | 2/1977 | Switzerland . |
| 1154381 | 6/1969 | United Kingdom . |

*Primary Examiner*—Andres Kashnikow
*Assistant Examiner*—Michael Mar
*Attorney, Agent, or Firm*—Sandler, Greenblum, & Bernstein

[57] ABSTRACT

A ski having a lower sliding surface and a pair of opposite lower edge portions; an upper surface; a central zone, a front contact zone and a rear contact zone; a pair of lateral surfaces on opposed sides of the ski, each of the pair of lateral surfaces extending between the upper surface and a respective one of the pair of opposite lower edge portions of the lower sliding surface; at least one of the pair of lateral surfaces being disposed, with respect to the lower sliding surface, to form an angle, in transverse cross-section, between a line representative of the at least one of the pair of lateral surfaces and a line extending between the pair of opposite lower edge portions, the angle decreasing continuously between said central zone and at least one of the front contact zone and the rear contact zone. The body of the ski can include a core which extends substantially the length of the body and a casing substantially surrounding the core for establishing the mechanical resistance properties of the ski. The outer profile of the ski, or the outer profile of the casing, is constructed and arranged such that the mechanical resistance properties of the ski at each location along the length of the ski is a function of such location.

105 Claims, 6 Drawing Sheets

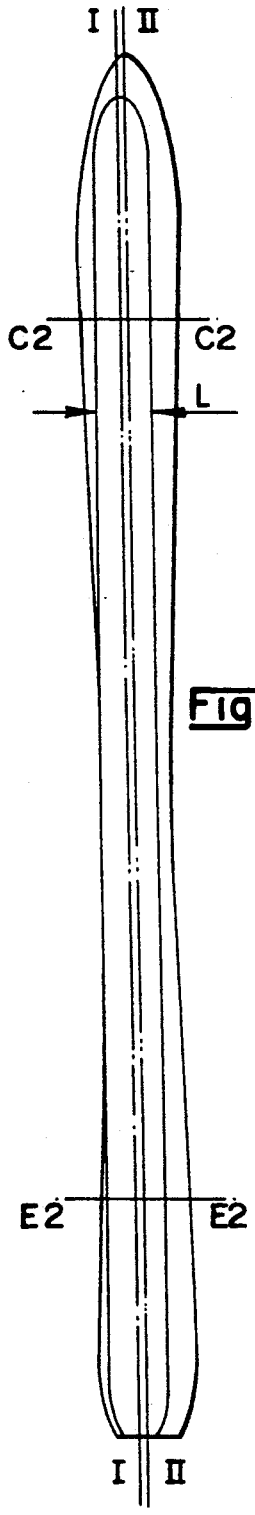
Fig- 13
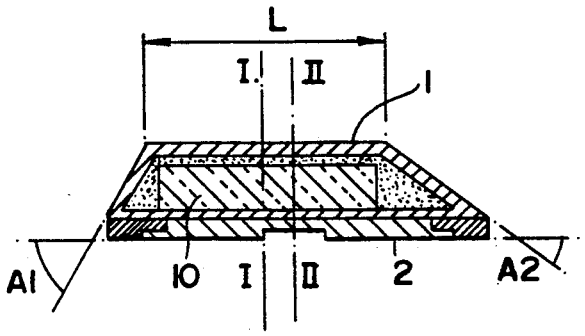
Fig- 14
Fig- 15
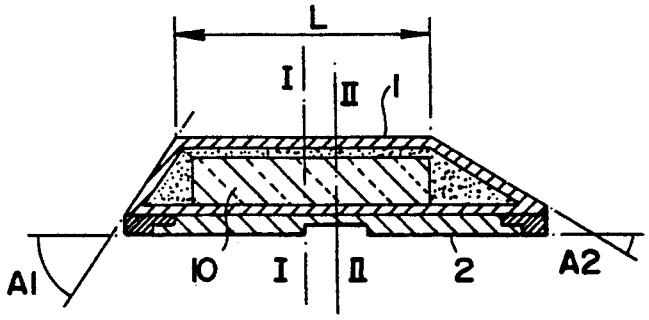

SKI HAVING IMPROVED SLIDING AND GRIPPING PROPERTIES

This application is a continuation of application Ser. No. 07/432,394, filed on Nov. 6, 1989, now abandoned, which is a continuation of application Ser. No. 07/157,467, filed on Feb. 18, 1988, now abandoned. This application is also a continuation-in-part of application Ser. No. 07/049,933, filed on May 15, 1987 now U.S. Pat. No. 4,838,572, issued on Jun. 13, 1989.

BACKGROUND OF THE INVENTION

1. Technical Field

The present invention relates to skis utilized in winter sports, and adapted to slide on snow and ice.

2. Background Art

A ski generally comprises a lower sliding surface having an angle iron on each lateral side edge for engaging snow, two lateral side surfaces defining the width of the ski, and an upper surface having means, located in a central binding zone, by which a user attaches his foot to the ski. The leading end of a ski is usually curved upwardly in the form of a spatula; and the ski is relatively narrow in width compared to its length which defines a longitudinal direction.

In conventional skis, the thickness of the body of a ski varies along the length of the ski in the longitudinal direction having a maximum in the binding zone where the flexional movements are a maximum during use of the ski. Because the thickness of the ski near the central zone is a maximum, and the thickness near the front and rear ends is a minimum, a uniform load distribution is achieved as disclosed in French Patent No. 985,174, for example.

French Patent Application Nos. 86 07849, 86 07850, 86 07851, and 86 07852, disclose skis whose lateral surfaces or edges have inclinations that vary along the length of the ski. The contact of these edges with the snow increases the stability of the skier particularly during execution of turns.

Conventional skis generally have a composite structure in which different materials are combined in the manner such that each composite operates in optimal fashion taking into account the distribution of the mechanical stresses in the skis. The composite structure comprises mechanical resistance or reinforcing elements or mechanical resistance layers made of material having a high mechanical resistance to strain and substantial rigidity so as to resist flexional and torsional stresses produced in a ski during its use. The conventional structure further includes filler elements and absorption elements.

The two principle modern composite structures finding current wide scale application in skis are the so-called sandwich and casing structures. In a typical sandwich structure, such as described in FIGS. 1 and 2 of French Patent No. 1 124 600, and in French Patent No. 2 069 824, the ski comprises a central core made of cellular material, which may be partially hollow, reinforced above and below respectively by an upper resistance layer and a lower resistance layer, the resistance layers having mechanical resistance and rigidifying qualities greater than those of the core itself.

It has been observed that a sandwich structure provides a ski that has the best sliding characteristics in a straight line, i.e., when the ski is moving in the longitudinal direction of the ski. On the other hand, the lateral gripping quality of such skis on inclines, or in turns, is not optimal; and for this reason, skis having a casing structure are preferred to optimize skiing on inclines or in executing turns.

In a typical casing structure, such as described in French Patent No. 985,174, and in FIG. 3 of French Patent No. 1,124,600, the ski comprises an internal core made of cellular material which may be partially hollow, and mechanical resistance elements surrounding the core in the form of layers that constitute a casing for the core. The casing structure confers superior elasticity and mechanical resistance properties to the ski in flexion, and a high torsional resistance along the longitudinal axis of the ski.

Skis having a casing structure have optimal lateral gripping qualities (en devers) for skiing on inclines or executing turns. On the other hand, the straight-line sliding characteristics of such skis are less desirable than skis having a sandwich structure.

As in the case with the exterior shape of a ski, the casing has a thickness which varies longitudinally by following the exterior shape of the ski. Despite this variable thickness, which leads to a casing having a greater thickness and rigidity at the center of the ski and less near the ends, the intrinsic properties of the casing produce sliding characteristics which are less desirable than those associated with a sandwich structure.

As a result, it is customary to select skis on the basis of the use to which the ski will be put. For example, a ski having a sandwich structure is selected for down hill competition because this structure has superior sliding characteristics; and a ski having a casing structure is selected for slalom competition because a casing structure has superior ice-gripping qualities.

SUMMARY OF THE INVENTION

An object of the present invention is to avoid the disadvantages of known ski structure by providing a ski that simultaneously optimizes sliding qualities, such as those normally associated with skis having a sandwich structure, and gripping qualities, such as those associated with skis having a casing structure.

A further object of the invention is to provide a ski having resistance properties that vary longitudinally without altering, in a substantial manner, the properties obtained by using a casing structure, by making it possible to substantially improve the sliding qualities of the skis.

A still further object of the present invention is to provide a ski having a continuous variation in the mechanical resistance properties of the ski as a function of the longitudinal position being considered without major modification to the structure of the ski thus constituting a homogeneity of structure and behavior, a good distribution of the reactions along the ski, and providing to the user an impression of comfort and regularity in the reactions of the ski.

A still further object of the present invention is to provide a ski in which its sliding and gripping qualities, and its reaction properties with the snow, are obtained by suitably configuring exterior shapes of the ski.

A ski, according to the present invention which achieves these and other objects, comprises a longitudinal extending body defining a longitudinal median plane and having a sole substantially perpendicular to the plane and adapted to slidably engage a surface, said sole having a central zone lying between front and rear contact zones. The body of the ski comprises a core which extends substantially the length of the body, and a casing substantially surrounding the core for establishing the mechanical resistance properties of the ski. Finally, the casing is constructed and arranged such that the mechanical resistance property of the ski varies longitudinally.

In the preferred form of the invention, the casing includes an upper layer integral with a pair of sidewalls that are laterally located on opposite sides of the median plane, the side walls being connected to a lower wall, at opposite lower edge portions, operatively associated with the sole of the ski. One of the sidewalls forms, with the lower layer, an effective angle A. More specifically, the angle A can be defined, in a cross-section transverse to the longitudinal median plane, as between a line extending between the opposite lower edge portions and a line representative of the sidewall. The angle A has a magnitude at a position along the length of the body which is a function of such position. Stated another way, at least one of the sidewalls slants toward the other, from bottom to top, by a magnitude which is a function of the magnitude of the angle A. Preferably, the magnitude of the angle A in the central zone of the ski is different from the angle A near one of the contact zones. Specifically, the magnitude of the angle A in the central zone of the ski is greater than the angle A near one of the contact zones. Specifically, the magnitude of the angle A and the central zone is greater than the angle A near the front contact zone and is greater than the angle A near the rear contact zone. Preferably, the magnitude of the angle A in the central zone is about 90°. In a specific embodiment, the angle A in the front contact zone is less than about 10° while the angle A near the rear contact zone is greater than about 10°.

The present invention also provides for the angle A to vary continuously along the length of the ski. Moreover, the angle A on each of the opposed lateral sidewalls may vary continuously along the length of the ski. In such a case, the opposed sidewalls may be symmetrically disposed with respect to the median plane along a substantial portion of the length of the ski. Alternatively, the opposed sidewalls may be asymmetrically disposed with respect to the median plane. Finally, a ski according to the present invention has a body that includes a lateral exterior wall covering and parallel to the respective sidewalls of the casing.

BRIEF DESCRIPTION OF DRAWINGS

Embodiments of the present invention are disclosed in the accompanying drawings wherein:

FIG. 13 is a top view of another embodiment of the ski according to the present invention having an asymmetrical cross-section different from that shown in FIG. 9 and showing a lateral translation of the upper surface of the ski with respect to the lower surface thereof;

FIGS. 14–15 are cross-sections of the ski of FIG. 13 taken along the line C2—C2 and E2—E2;

DETAILED DESCRIPTION OF THE INVENTION

The present invention provides a ski whose body comprises, substantially over its entire length, a core surrounded by a mechanical resistance casing comprising an upper resistance connected to two lateral resistance sidewalls which are themselves connected to a lower resistance layer. At least one of the lateral resistance walls has, with respect to the lower resistance layer, an inclination angle A whose value varies along the length of the ski as a function of the position along the length of the ski. The variation in inclination confers to the ski a variation in the mechanical resistance properties of the ski along the length thereof. The portions of the casing in which the inclination angle A is close to 90° act, mechanically, as a conventional casing. Portions in which the angle A is close to 0° act, mechanically, as if the ski were a sandwich structure. The general structure of the body of the ski remains, however, homogeneous, with a core surrounded by a mechanical resistance casing.

According to one embodiment of the invention, the inclination angle A in the central or binding zone of the ski, is greater than the inclination angle near at least one of the ends of the contact zone of the ski. Such a distribution of the inclination angle makes it possible to preserve for the ski the turning qualities of a ski having a conventional casing, while substantially improving its sliding properties. This phenomenon is all the more notable when the inclination angle A is small in the vicinity of the front contact zone of the ski, or when the inclination angle is small in the vicinity of both the front and rear contact zones.

Preferably, longitudinal symmetry of the ski is provided by positioning lateral resistance walls symmetrically to one another with respect to the vertical longitudinal median plane of the ski passing through the axis I—I.

Improvement in sliding properties are also obtained when the lateral resistance walls are asymmetrical with respect to the vertical and longitudinal median plane of the ski. The asymmetry may vary as a function of a longitudinal position being considered along the ski.

According to another embodiment, the inclination angle A is no greater than about 90° over the entire length of the casing. Preferably, the inclination angle A may assume a value very close to 90° in the central zone of the body of the ski, achieving the maximum effect of the casing type structure. In the vicinity of at least one of the two contact zones, the inclination angle A preferably may be selected to be small, particularly less than 10°. Preferably, the inclination A varies in a continuous manner along the body of the ski so as to produce a mechanical resistance which continuously varies.

Figure 4:
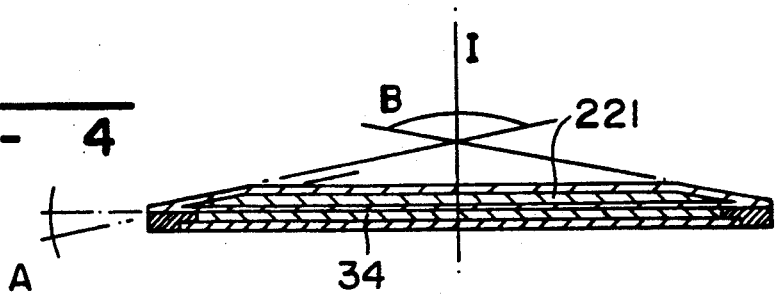
FIGS. 4–8 are transverse cross-sections of the ski shown in FIG. 2 taken along the lines B—B, C—C, D—D, E—E, and F—F, respectively.

According to a further embodiment of the invention, the lateral resistance walls are substantially parallel to the corresponding lateral exterior surface of the ski. In this arrangement, the effect of the exterior shape of the ski, which produces a particular behavior during turns, is combined with effects of the particular casing structure having a variable inclination angle, i.e., with good gripping and good sliding of the ski. This is, in a specific embodiment of the invention, angle A decreases in a continuous manner from a central zone of the ski toward at least one of the two contact zones. This characteristic of the invention can also be described, of course, with respect to the two lateral exterior surfaces, i.e., the sidewalls of the ski, themselves. That is, in transverse cross-section, a line formed by one of the sidewalls intersects a line formed by the other of the sidewalls at an angle B, as shown in FIG. 4. Whereas angle A continuously decreases from a central zone toward at least one of the two contact zones, angle B continuously increases from a central zone toward at least one of the two contact zones.

Figure 1:
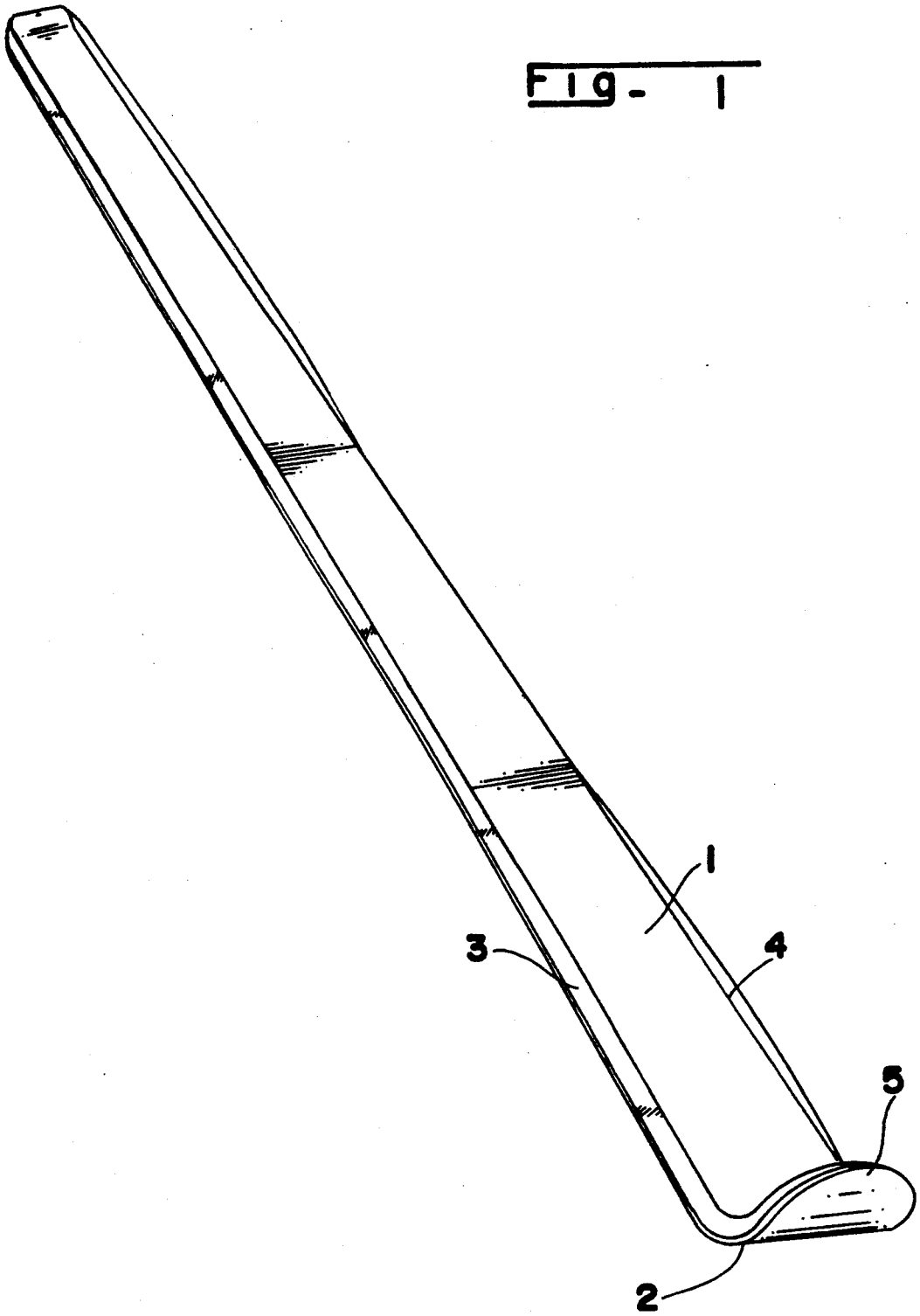
FIG. 1 is a perspective view of a ski according to the present invention.
Figure 3:
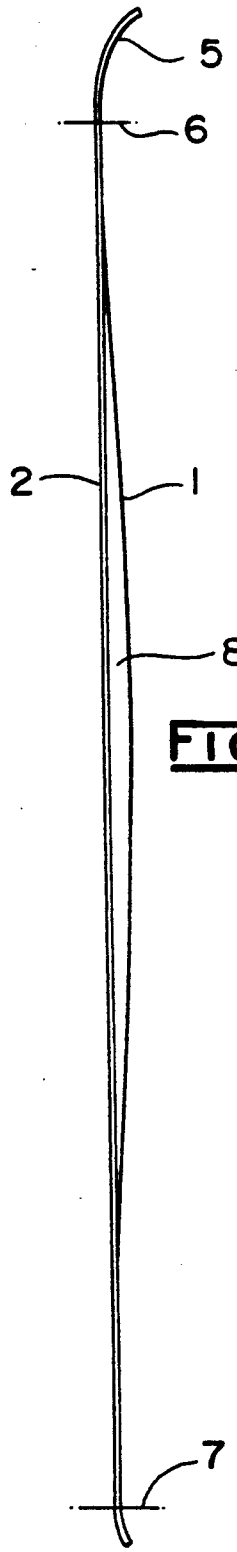
FIG. 3 is a side view of the ski shown in FIG. 1.
Figure 2:
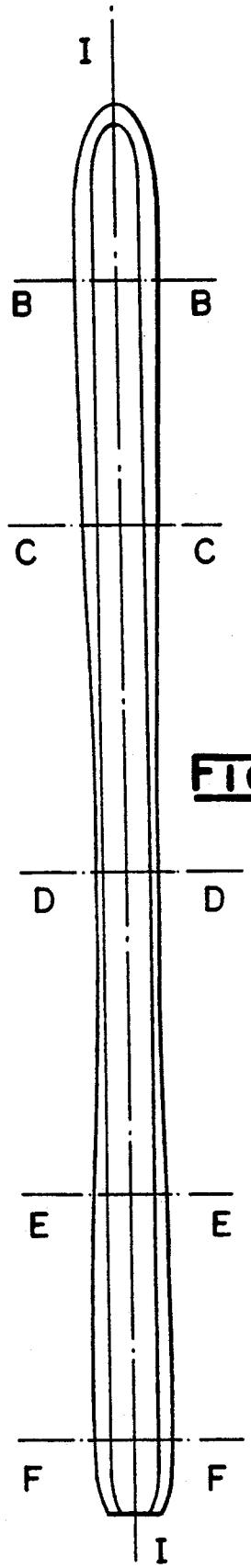
FIG. 2 is a top view of the ski shown in FIG. 1.

Referring now to FIGS. 1 and 3 of the drawing, a ski according to the present invention comprises, in general fashion, upper surface 1, a sole in the form of a lower or sliding surface 2, first lateral surface 3, second lateral surface 4, and front and 5 upwardly curved in the shape of a spatula. Lower surface 2 of the ski is curved upwardly between front contact zone 6 and rear contact zone 7. The body of the ski, or that portion of the ski between front contact zone 6 and rear contact zone 7, has a maximum thickness in central zone 8. The thickness of the ski progressively decreases from zone 8 towards zones 6 and 7.

Figure 5:
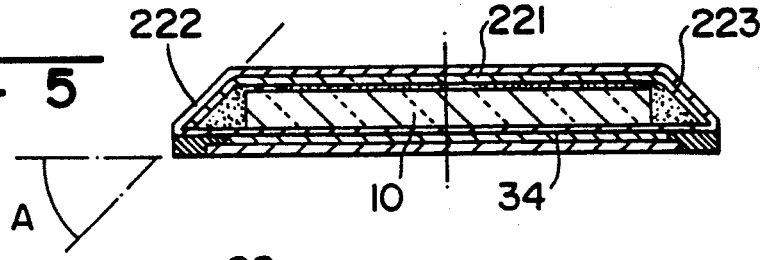
Figure 6:
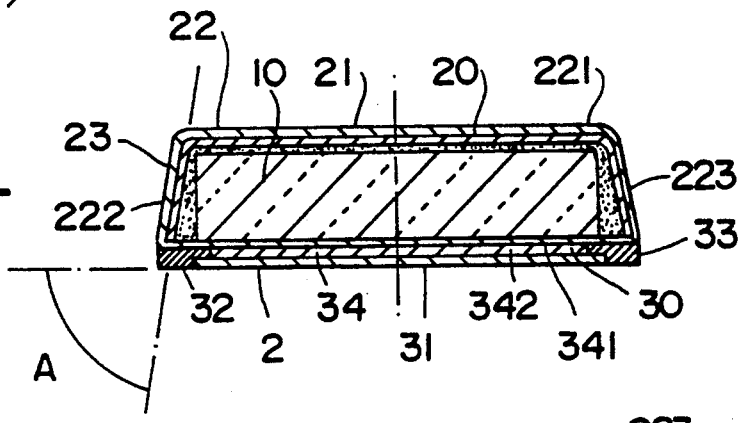

In the embodiment shown in FIGS. 1–8, the ski has a mechanical resistance casing structure which is symmetrical with respect to longitudinal median axis I—I of the ski through which passes a longitudinal median plane that is perpendicular to surface 2. FIG. 6 is a transverse cross-section of the ski near control zone 8 taken along the line D—D. As shown in this cross-section, the ski comprises three principle portions: core 10 having a substantially rectangular cross-section, shell 20, and lower element 30.

Core 10 may have a cellular structure, and may be wood, synthetic foam, or aluminum honeycomb. The core can likewise be partially hollow, and constituted, for example, by metallic or plastic tubes.

Shell 20, in this embodiment, is a composite shell comprising outer exterior layer 21 of thermoplastic material, for example, and reinforcement layer 22 constituted from a material having high mechanical resistance such as stratified aluminum or aluminum alloy. Interior filler layer 23 bonds core 10 to reinforcement layer 22.

Exterior layer 21 may be a thermoplastic material such as acrylonitrile, butadiene styrene, generally designated as ABS, polyamide, or a polycarbonate. Reinforcement layer 22 may be one or more sheets of woven glass, carbon or other material, these layers preferably being pre-impregnated with a thermoplastic resin such as a polyetherimide, or with a thermosetting resin such as an epoxyde or a polyurethane. The fabric is preferably oriented, and has, for example 90% of fibers in the longitudinal direction of the ski, and 10% in the transverse direction. The reinforcement layer 22 may be a metallic alloy having a high elastic limit, or glass fibers, or even a combination of these two materials.

Filling layer 23 may be a thermoplastic material, either of the same type as the exterior layer, or a different type. For example, layer 23 may be of the type whose melting point is lower than that of the exterior layer.

Lower element 30 comprises sole 31 of polyethylene constituting lower or sliding surface 2 of the ski. Lateral angles, 32 and 33, are of steel, and lower resistance layer 34 is a mechanically resistant material. For example, lower resistance layer 34 may have a composite structure, comprising lower layer 341 made of glass fibers and upper layer 342 made of aluminum alloy or stratified aluminum. Lower resistance layer 34 is integrated, along its lateral edges, with the corresponding lower lateral edges of reinforcement layer 22 of shell 30.

Reinforcement layer 22 of shell 20 has, as seen in the drawings, an inverted U-shaped structure which constitutes upper resistance layer 221 integrally connected to two lateral resistance walls 222 and 223. The lower edges of these walls are connected to the lateral edges of lower resistance layer 34. Preferably, the connections are integral ones. As a result, reinforcement layer 22 of the shell and lower resistance layer 34 constitute an enclosed casing structure that surrounds core 10. As is seen in FIGS. 4–8, the shape and cross-section dimensions of the casing vary along the length of the ski. Thus, in the central zone shown in FIG. 6, the casing has a trapezoidal cross-section wherein lateral resistance walls 222 and 223 are slightly inclined with respect to the longitudinal median plane passing through axis I—I of the ski; and the inclination angle A has a value close to 90°.

Figure 7:
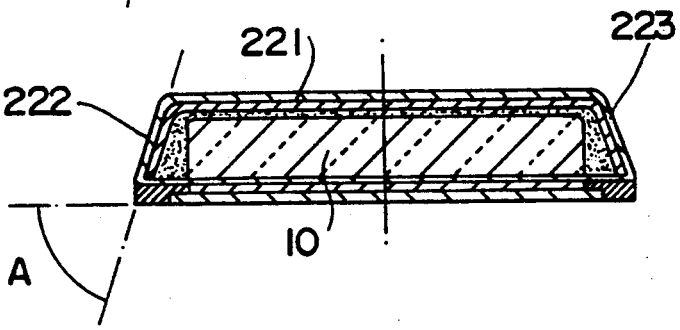
Figure 8:
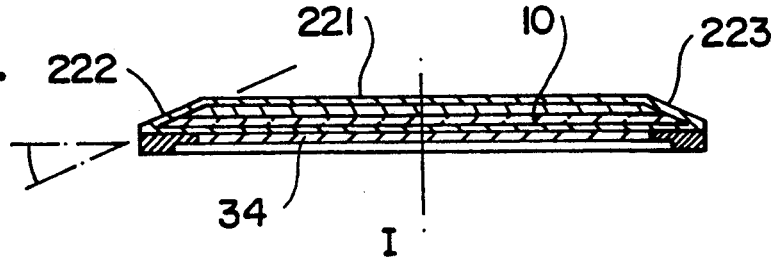
Figure 9:
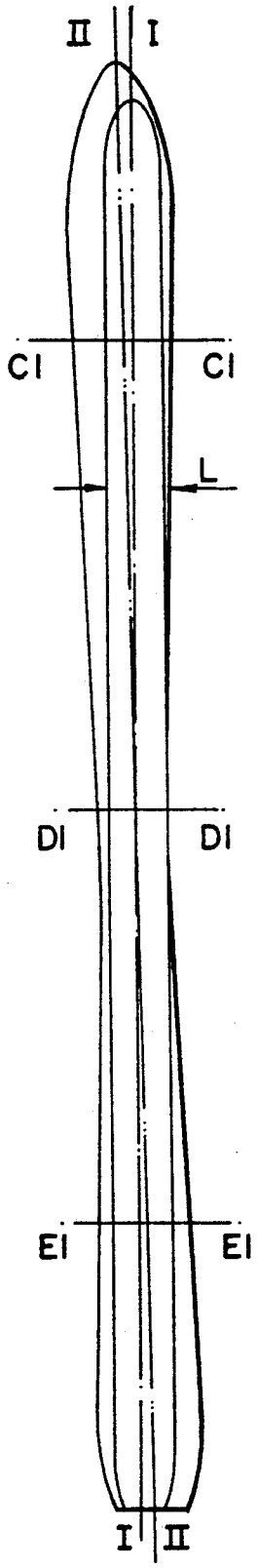
FIG. 9 is a top view of another embodiment of a ski according to the present invention, the ski having an asymmetrical cross-section which varies as a function of the longitudinal position being considered.

In FIG. 7, in the rear intermediate zone E—E of the ski, the height of the casing is reduced compared to zone D—D; and the inclination angle A is also reduced, for example, from about 90° to about 70°. In the vicinity of the rear contact zone, FIG. 8 shows that the casing is very much flattened and its thickness is very small. Simultaneously, the inclination angle is also small, for example, about 10°–20°. The core 10 also has a very small thickness.

Likewise, in the front intermediate zone of the ski shown in FIG. 5, or zone defined by cross-section C—C, the casing has a reduced height and the inclination A is small, for example, close to 45°.

Near front contact zone 6, the casing is very flattened and is constituted by the two resistance layers, the upper and lower ones are joined one on top of the other. The range of inclination angle A is from 0° to less than about 10°.

The structure of FIG. 6 is a traditional casing. The structure of FIG. 4, and of FIG. 8, even though it is in the form of a casing, behaves as if it were a sandwich-type structure because angle A is small. The transition in behavior from one structure to the other occurs gradually, be progressive diminution of the thickness of the ski and simultaneous diminution of the inclination angle A in passing from the central zone of the ski shown in FIG. 6 to an end zone shown in FIGS. 4 or 8.

The present invention also contemplates providing a symmetrical structure of the type shown in FIGS. 1–8 by selecting certain constructional variations. For example, the central zone of a ski according to the present invention may have substantially vertical lateral resistance walls 222 and 223, the inclination angle thus being close to 90°. In another embodiment, the inclination angle A in the central zone may be less than 90°, for example 80° as seen in FIG. 6.

The lower resistance layer, may be homogeneous, or, alternatively, may comprise a single layer of mechanical resistant material, or two or more of such layers. The presence of exterior layer 21 is not indispensable in obtaining the particular effects according to the invention. Consequently, exterior layer 21 and reinforcement layer 22 may be one and the same as the reinforcement layer.

Figure 10:
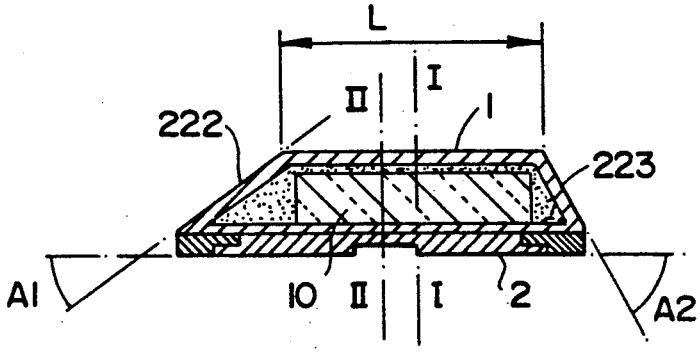
FIGS. 10–12 are transverse cross-sections of the ski of FIG. 9 taken along the lines C1—C1, D1—D1, and E1—E1, respectively.
Figure 11:
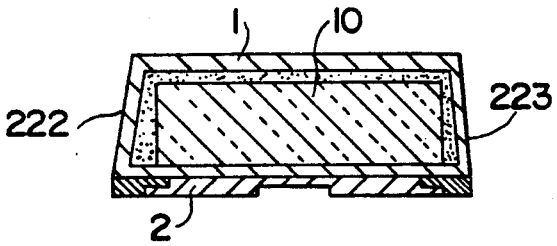
Figure 12:
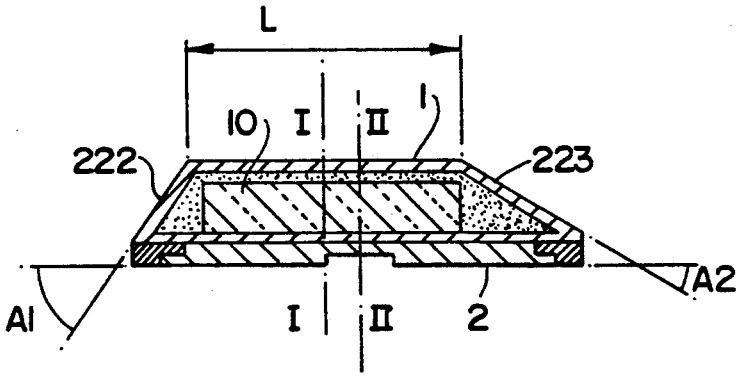

The variations described above can be applied to the embodiments described below in which the traverse cross-section of the ski is asymmetrical. In the embodiments shown in FIGS. 9–12, the cross-section of the ski according to the present invention has a variable asymmetry along the length of the ski. Thus, in the front zone of the ski, as shown in cross-section C1—C1 in FIG. 10, one lateral resistance wall 22 of the casing has an inclination angle A1 which is smaller than the inclination angle A2 of the opposite lateral resistance wall 223. On the other hand, in the rear zone, shown in cross-section in FIG. 12, the angle A1 is greater than the angle A2; and, in the central zone of the ski shown in cross-section shown in FIG. 11, angles A1 and A2 are equal.

In the embodiment shown in FIGS. 13–15, the ski is likewise asymmetrical, and the asymmetry is always in the same direction with respect to the longitudinal plane of the ski. In this case, the inclination angle A1 is greater than the inclination angle A2 over the entire length of the ski.

In these two preceding embodiments, angles A1 and A2, at a particular length-wise location of the ski, vary as a function of such location, the variation being of the same type as shown in the embodiment of FIGS. 1–8. In the central zone, the angle allows for a maximum value, and decreases approaching the ends of the ski.

Figure 16:
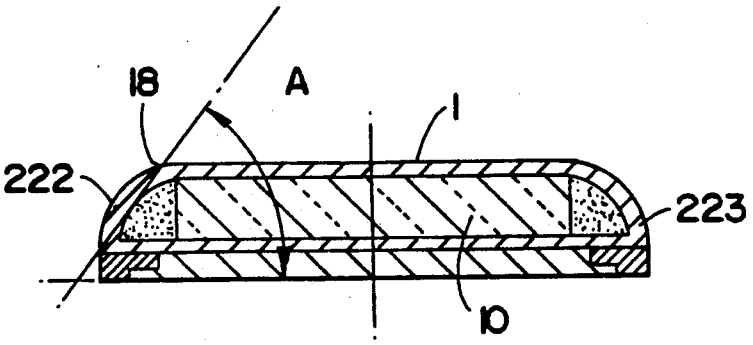
FIG. 16 is a further embodiment according to the present invention in which the lateral surfaces of the casing are convex.
Figure 17:
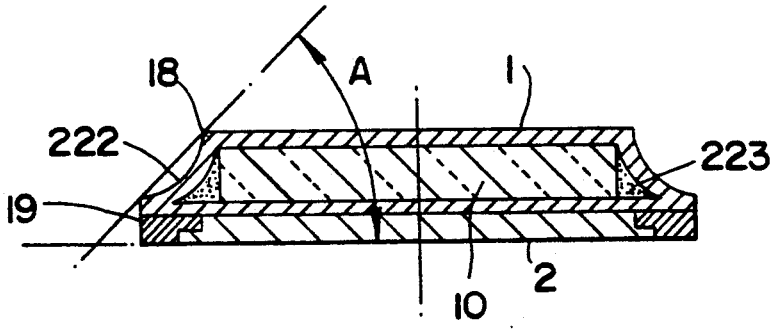
FIG. 17 is a further embodiment of the present invention which the lateral surfaces of the casing are concave.
Figure 18:
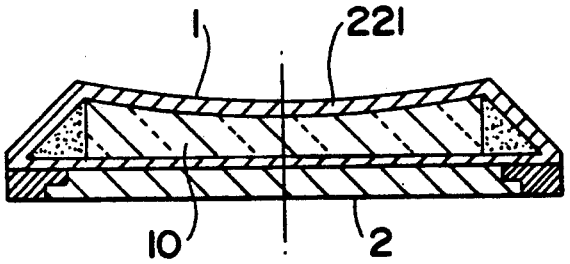
FIG. 18 is an embodiment of the invention in which the upper surface of the casing is concave.

FIGS. 16–18 illustrate several other alternatives of the longitudinal profile of the casing according to the invention. Thus, in FIG. 16, the lateral resistance walls 222 and 223 are convex, for example, in the form of a portion of a cylinder. In FIG. 17, the lateral resistance walls 222 and 223 are concave. Although the walls 222 and 223 may be curved as shown in FIGS. 16 and 17, even the curved walls define an effective angle A as indicated. In FIG. 18, the upper resistance layer is concave, while in the preceding embodiments it was substantially planar and simply longitudinally curved upwardly.

In the embodiments shown, the lateral resistance walls 222 and 223 are substantially parallel to respective lateral exterior surfaces 4 and 3 of the ski; and, in certain embodiments, these walls constitute by themselves the same lateral exterior surfaces. The inclination of the lateral resistance walls and the variation inclination as a function of length serve to modify the behavior of the casing of the ski for longitudinal sliding and transverse gripping in the snow, and of the behavior of the ski connected to the form of the lateral surfaces of the ski.

The ski according to the present invention can be manufactured by conventional means, for example, by a process described in French Document 984 174. However, a ski formed in accordance with the present invention can similarly be formed in accordance with the process described in French Patent Application No. 8703119, filed on even date by the present assignee, the disclosure of which is hereby incorporated by reference.

The advantages and improved results achieved by the apparatus of the present invention are apparent from the foregoing description of the preferred embodiment of the invention. Various changes and modifications may be made without departing from the spirit and scope of the invention as described in the claims that follow.

We claim:

1. A ski comprising:

(a) a longitudinally extending body defining a longitudinal median plane having a sole and a pair of opposite lower edge portions, a line extending in transverse cross-section between said pair of opposite lower edge portions being substantially perpendicular to the plane, said sole being adapted to slidably engage a surface, said sole having a central zone located between front and rear contact zones;

(b) said body comprising a core which extends at least between said contact zones, and a casing substantially surrounding said core and comprising reinforcement layers for establishing mechanical resistance properties of the ski and a pair of lateral exterior surfaces forming respective angles between each of said lateral exterior surfaces and said line between said pair of opposite lower edge portions, each of said angles being defined, in transverse cross-section, between a line representative of one of said lateral exterior surfaces and said line extending between said pair of opposite lower edge portions;

(c) said casing comprising (1) means in the vicinity of said central zone for providing the ski with mechanical resistance properties that produce optimal gripping qualities during skiing on inclines and executing turns, which are normally associated with a box construction, and (2) means in the vicinity of said front and rear contact zones for providing the ski with mechanical resistance properties that produce optimal straight-line sliding qualities, which are normally associated with a sandwich construction, said means for providing the ski with mechanical resistance properties that produce optimal gripping qualities and optimal straight-line sliding qualities comprising continuously reducing at least one of said angles at least from said central zone to at least one of said front and rear contact zones.

2. A ski according to claim 1, further comprising opposite side walls extending along the ski, wherein said means in the vicinity of said front and rear contact zones comprises at least one of said side walls of said casing being disposed to form an angle with respect to said sole which is less than an angle formed by said at least one of said side walls with respect to said sole in the vicinity of said central zone.

3. A ski according to claim 2, wherein an angle formed with respect to said at least one of said side walls and said sole is continuously variable from an area proximate said central zone to said vicinity of at least one of said front and rear contact zones.

4. A ski according to claim 3, wherein said angle formed with respect to said at least one of said side walls and said sole in said front contact zone is between 0° and less than about 10°.

5. A ski according to claim 3, wherein said angle formed with respect to said at least one of said side walls and said sole in said rear contact zone is between about 10° and 20°.

6. A ski according to claim 3, further comprising a front intermediate zone between said central zone and said front contact zone, wherein an angle formed with respect to said at least one of said side walls and said sole in said front intermediate zone is approximately 45°.

7. A ski comprising:

(a) a longitudinally extending body defining a longitudinal median plane and having a sole and a pair of opposite lower edge portions, a line extending in transverse cross-section between said pair of opposite lower edge portions being substantially perpendicular to the plane, said sole being adapted to slidably engage a surface, said sole having a central zone lying between front and rear contact zones;

(b) said body comprising a core which extends substantially the length of the body and a casing substantially surrounding said core for establishing mechanical resistance properties of the ski;

(c) said casing being constructed and arranged to comprise means for continuously longitudinally varying said mechanical resistance properties of the ski at least from said central zone to at least one of said front and rear contact zones, said casing including: (1) an upper layer connected to a pair of lateral sidewalls that are laterally located on opposite sides of said median plane, said sidewalls being connected to a lower layer operatively associated with said sole; and (2) at least one of said sidewalls forming an effective angle A, in transverse cross-section, between a line representative of said at least one of said pair of lateral surfaces and said line extending between said pair of opposite lower edge portions, said angle A having a magnitude along the length of said body which continuously decreases as a function of position along the length of said body at least from said central zone to at least one of said front and rear contact zones.

8. A ski according to claim 7 wherein the magnitude of the angel A varies continuously along the length of the ski.

9. A ski according to claim 8 where the magnitude of the angle A of the other side wall of the ski varies continuously along the length.

10. A ski according to claim 9 wherein the opposite side walls are symmetrically disposed with respect to the median plane along a substantial portion of the length of the ski.

11. A ski according to claim 10 wherein the magnitude of the angel A in the central zone is greater than the magnitude of the angle A near each contact zone for each side wall.

12. A ski according to claim 11 wherein the magnitude of the angle A is approximately 90° in the central zone for each sidewall.

13. A ski according to claim 9 wherein the opposite sidewalls are asymmetrically disposed with respect to the median plane along a substantial portion of the length of the ski.

14. A ski according to claim 13 wherein the magnitude of the angle A in the central zone is greater than the magnitude of the angle A near each contact zone for each sidewall.

15. A ski according to claim 9 wherein said body includes a lateral exterior wall covering and parallel to the respective sidewalls of the casing.

16. A ski according to claim 7, wherein said casing is constructed and arranged to comprise means for continuously longitudinally varying said mechanical resistance properties of the ski from said central zone to both of said front and rear contact zones.

17. A ski comprising:

(a) a longitudinally extending body defining a longitudinal median plane and having a sole and a pair of opposite lower edge portions, a line extending between said pair of opposite lower edge portions being substantially perpendicular to the plane, said sole being adapted to slidably engage a surface, said sole having a central zone lying between front and rear contact zones;

(b) said body being symmetrical with respect to said median plane, and comprising a core extending at least between a front intermediate zone lying between the central and front zones, and a rear intermediate zone lying between the central and rear zones, and a casing including a top surface and sidewalls encompassing said core establishing mechanical resistance properties of the ski; and (c) said casing comprising (1) means in the vicinity of said central zone for providing the ski with mechanical resistance properties that produce optimal gripping qualities during skiing on inclines and executing turns, which are normally associated with a box construction, and (2) means in the vicinity of the front and rear contact zones for providing the ski with mechanical resistance properties that produce optimal straight-line sliding qualities, which are normally associated with a sandwich construction, by providing an angle between at least one of said pair of lateral surfaces and said line extending between said pair of opposite lower edge portions of said lower sliding surface, which angle decreases, as a function of position along the ski, at least from said central zone to at least one of said front contact zone and said rear contact zone.

18. A ski according to claim 17 wherein said core is rectangular in transverse cross-section.

19. A ski according to claim 18 wherein the thickness of the core is a function of the distance along the length of the ski.

20. A ski according to claim 17 wherein the thickness of the core is a function of the distance along the length of the ski.

21. A ski according to claim 20 wherein the side walls, at each transverse cross-section of the ski between the front and rear zones, form an angle A with the sole of the ski, and wherein the angle A is a function of the distance along the length of the ski.

22. A ski according to claim 21 wherein the angle A in the central region is in the range of about 80°-90°.

23. A ski according to claim 22 wherein the angle A in the vicinity of the front zone is in the range of about 0°-10°.

24. A ski according to claim 23 wherein the angle A in the vicinity of the rear zone is in the range of about 10°-20°.

25. A ski according to claim 22 wherein the angle A in the vicinity of the rear zone is in the range of about 10°-20°.

26. A ski according to claim 17 wherein said core is uniform width along its length.

27. A ski comprising:

(a) a longitudinally extending body defining a longitudinal median plane and having a sole and a pair of opposite lower edge portions, a line extending in transverse cross-section between said pair of opposite lower edge portions, said line being substantially perpendicular to the plane, said sole being adapted to slidably engage a surface, said sole having a central zone lying between front and rear contact zones;

(b) said body being symmetrical with respect to said median plane, and comprising a core extending at least between a front intermediate zone lying between the central and front zones, and a rear intermediate zone lying between the central and rear zones, and a casing including a top surface and sidewalls encompassing said core establishing the mechanical resistance properties of the ski; and (c) said ski being constructed and arranged such that the mechanical resistance properties of the ski are a function of the distance along the length of the ski, and wherein the sidewalls, at each transverse cross section of the ski between the front and rear zones, forms an angle A with said line extending between said pair of opposite lower edge portions of the sole of the ski, and wherein the angle A decreases continuously along the length of the ski at least from the vicinity of said central zone and to at least one of said front and rear contact zones.

28. A ski according to claim 27 wherein the angle A in the central region is in the range of about 80°-90°.

29. A ski according to claim 28 wherein the angle A in the vicinity of the front zone is in the range of about 0°-10°.

30. A ski according to claim 29 wherein the angle A in the vicinity of the rear zone is in the range of about 10°-20°.

31. A ski according to claim 28 wherein the angle A in the vicinity of the rear zone is in the range of about 10°-20°.

32. A ski according to claim 17 wherein the thickness of the body is a function of the distance along the length of the ski.

33. A ski according to claim 32 wherein the thickness is a maximum in the central region.

34. A ski according to claim 27 wherein the thickness of the body is a function of distance along the length of the ski.

35. A ski according to claim 28 wherein the thickness of the body is a function of the distance along the length of the ski.

36. A ski according to claim 29 wherein the thickness of the body is a function of the distance along the length of the ski.

37. A ski according to claim 30 wherein the thickness of the body is a function of the distance along the length of the ski.

38. A ski according to claim 31 wherein the thickness of the body is a function of the distance along the length of the ski.

39. A ski comprising:

(a) a longitudinally extending body defining a longitudinal median plane having a sole and a pair of opposite lower edge portions, a line extending in transverse cross-section between said pair of opposite lower edge portions being substantially perpendicular to the plane, said sole being adapted to slidably engage a surface, said sole having a central zone located between front and rear contact zones;

(b) said body comprising a core which extends substantially the length of the body at least between said contact zones, and a casing substantially surrounding said core and comprising reinforcement layers for establishing mechanical resistance properties of the ski;

(c) said casing having two lateral sidewalls that are located on opposite sides of said median plane;

(d) at least one of said two lateral sidewalls forming with said sole an effective angle A, in transverse cross-section, between a line representative of said one of said two lateral sidewalls and said line between said pair of opposite lower edge portions, said angle having a value which is greater in said central zone than in at least one of said front and rear contact zones; and (e) said effective angle varying continuously along the length of the ski at least from said central zone to one of said front and rear contact zones.

40. A ski according to claim 39 wherein the magnitude of angle A in the central zone of the ski is different from the magnitude of the angle A near one of the contact zones.

41. A ski according to claim 40 wherein the magnitude of the angle A in the central zone of the ski is greater than the magnitude of the angle A near one of the contact zones.

42. A ski according to claim 41 wherein the magnitude of the angle A in the central zone is greater than the magnitude of the angle A near the front contact zone.

43. A ski according to claim 42 wherein the magnitude of the angle A in the central zone is greater than the magnitude of the angle A near the rear contact zone.

44. A ski according to claim 43 wherein the magnitude of the of angle A in the central zone is about 90°.

45. A ski according to claim 43 wherein the magnitude of the angle A in the central zone is approximately 90° and the magnitude of the angle A near one contact zone is less than about 10°.

46. A ski according to claim 45 wherein the contact zone where the magnitude of the angle A is less than about 10° is the front contact zone.

47. A ski according to claim 46 wherein the magnitude of the angle A near the rear contact zone is greater than about 10°.

48. A ski according to claim 41 wherein the magnitude of the angle A in the central zone is greater than the magnitude of the angle A near the rear contact zone.

49. A ski according to claim 39 wherein the magnitude of angle A in the central zone of the ski is greater than the magnitude of the angle A near each contact zone.

50. A ski according to claim 40 wherein the width of the body varies along the length thereof.

51. A ski according to claim 50 wherein the body is wider near the front and rear contact zones than near the central zone.

52. A ski according to claim 40 wherein the thickness of the body varies along the length thereof.

53. A ski according to claim 52 wherein the body is thicker in the central zone than near the front and rear contact zones.

54. A ski according to claim 53 wherein the body is wider near the front and rear contact zones than near the central zone.

55. A ski according to claim 54 wherein the transverse cross-section of the body is symmetrical relative to the longitudinal median plane.

56. A ski according to claim 54 wherein the transverse cross-section of the body is asymmetrical relative to the longitudinal median plane.

57. A ski according to claim 40 wherein one of said side walls is curved.

58. A ski according to claim 57 wherein said one of said side walls is concavely curved.

59. A ski according to claim 57 wherein said one of said side walls is convexly curved.

60. A ski according to claim 40 wherein said upper wall is concavely curved.

61. A ski comprising:

(a) a longitudinally extending body defining a longitudinal median plane having a sole and a pair of opposite lower edge portions, a line extending in transverse cross-section between said pair of opposite lower edge portions being substantially perpendicular to the plane, said sole being adapted to slidably engage a surface, said sole having a central zone located between front and rear contact zones;

(b) said body comprising a core which extends substantially the length of the body at least between said contact zones, and a casing substantially surrounding said core and comprising reinforcement layers for establishing mechanical resistance properties of the ski;

(c) said casing having two lateral sidewalls that are located on opposite sides of said median plane;

(d) at least one of said two lateral sidewalls forming with said sole an effective angle A, in transverse cross-section, between a line representative of said one of said two lateral sidewalls and said line extending between said pair of opposite lower edge portions, said angle varying continuously from said central zone to the vicinity of at least one of said front and rear contact zones;

(e) said effective angle A being less than 45° in the vicinity of at least one of said front and rear contact zones to produce optimal straight line sliding characteristics for the ski in said at least one of said front and rear contact zones, which characteristics are normally associated with a sandwich construction; and (f) said value of said effective angle A being greater in said central zone than said value of said effective angle A near at least one of said front and rear contact zones to produce optimal gripping characteristics during skiing on inclines and executing turns, which characteristics are normally associated with a box construction.

62. A ski comprising:

(a) a lower sliding surface and a pair of opposite lower edge portions;

(b) an upper surface;

(c) a central zone, a front contact zone and a rear contact zone;

(d) a pair of lateral surfaces on opposed sides of the ski, each of said pair of lateral surfaces extending between said upper surface and a respective one of said pair of opposite lower edge portions of said lower sliding surface;

(e) at least one of said pair of lateral surfaces being disposed, with respect to said lower sliding surface, to form an angle, in transverse cross-section, between a line representative of said at least one of said pair of lateral surfaces and a line extending between said pair of opposite lower edge portions, said angle decreasing continuously from said central zone to at least one of said front contact zone and said rear contact zone.

63. A ski according to claim 62 wherein the ski has a thickness which decreases from said central zone to at least each of said front contact zone and said rear contact zone, respectively.

64. A ski according to claim 62 further comprising lateral angle elements on opposed sides of the ski, forming lower longitudinal edges of said ski.

65. A ski according to claim 64 wherein said lateral angle elements form surfaces which are generally perpendicular to said lower sliding surface and which are positioned adjacent said pair of longitudinally extending lateral surfaces.

66. A ski according to claim 62 wherein each of said pair of lateral surfaces is disposed at an angle which decreases continuously from said central zone to at least one of said front contact zone and said rear contact zone.

67. A ski according to claim 66 wherein said ski is symmetrical with respect to a vertical longitudinal median plane.

68. A ski according to claim 62 wherein said ski is asymmetrical with respect to a vertical longitudinal median plane.

69. A ski according to claim 62 wherein each of said pair of lateral surfaces is disposed at an angle which decreases continuously from said central zone to each of said front contact zone and said rear contact zone.

70. A ski according to claim 62 further comprising a front intermediate zone, wherein said angle at said front intermediate zone of said at least one of said pair of lateral surfaces with respect to said lower sliding surface is approximately 45°.

71. A ski according to claim 70 wherein said angle at said front contact zone of said at least one of said pair of lateral surfaces with respect to said lower sliding surface is approximately 0° to less than about 10°.

72. A ski according to claim 62 further comprising a rear intermediate zone, wherein said angle at said rear intermediate zone of said at least one of said pair of lateral surfaces with respect to said lower sliding surface is approximately 70°.

73. A ski according to claim 72 wherein said angle at said rear contact zone of said at least one of said pair of lateral surfaces with respect to said lower sliding surface is approximately 10° to 20°.

74. A ski according to claim 62 comprising a core, a casing, and a lower element, said casing and lower element surrounding said core.

75. A ski according to claim 74 wherein said casing comprises said upper surface and said pair of lateral surfaces.

76. A ski according to claim 75 wherein said casing comprises a shape and cross-section dimensions which continuously vary at least between said central zone and one of said front contact zone and said rear contact zone.

77. A ski according to claim 75 wherein said casing comprises a shape and cross-section dimensions which continuously vary between said central zone and each of said front contact zone and said rear contact zone, respectively.

78. A ski according to claim 62 wherein said lateral surfaces are convex.

79. A ski according to claim 62 wherein said lateral surfaces are concave.

80. A ski according to claim 62 wherein said pair of lateral surfaces are external surfaces of said ski.

81. A ski comprising:

(a) a lower sliding surface;

(b) an upper surface;

(c) a central zone, a front contact zone and a rear contact zone;

(d) a pair of lateral surfaces on opposed sides of the ski between said lower sliding surface and said upper surface;

(e) said ski having a gripping capability and a sliding capability; and (f) means for continuously reducing said gripping capability and for continuously increasing said sliding capability from said central zone toward at least one of said front contact zone and said rear contact zone, said means comprising at least one of said pair of lateral surfaces slanting toward the other of said pair of lateral surfaces, from bottom to top of said lateral surfaces, wherein lines formed by said lateral surfaces in transverse cross-section, intersect to form an angle having a magnitude which continuously increases from said central zone toward at least one of said front contact zone and said rear contact zone.

82. A ski according to claim 81 wherein said means for continuously reducing said gripping capability and for increasing said sliding capability from said central zone toward at least one of said front contact zone and said rear contact zone comprises disposing at least one of said pair of lateral surfaces at an angle, with respect to said lower sliding surface, which decreases continuously between said central zone and at least one of said front contact zone and said rear contact zone.

83. A ski according to claim 81 further comprising means for continuously reducing said gripping capability and for increasing said sliding capability from said central zone toward each of said front contact zone and said rear contact zone, respectively.

84. A ski according to claim 83 wherein said means for continuously reducing said gripping capability and for increasing said sliding capability from said central zone toward each of said front contact zone and said rear contact zone comprises disposing at least one of said pair of lateral surfaces at an angle, with respect to said lower sliding surface, said angle decreasing continuously between said central zone and each of said front contact zone and said rear contact zone, respectively.

85. A ski according to claim 83 wherein said means for continuously reducing said gripping capability and for increasing said sliding capability from said central zone toward each of said front contact zone and said rear contact zone comprises disposing both of said pair of lateral surfaces at respective angles, with respect to said lower sliding surface, said respective angles decreasing continuously between said central zone and each of said front contact zone and said rear contact zone, respectively.

86. A ski according to claim 81 wherein said means for continuously reducing said gripping capability and for continuously increasing said sliding capability from said central zone toward at least one of said front contact zone and said rear contact zone comprises at least one of said pair of lateral surfaces being disposed at an angle, with respect to said lower sliding surface, said angle decreasing continuously between said central zone and at least one of said front contact zone and said rear contact zone.

87. A ski according to claim 86 wherein the ski has a thickness which decreases from said central zone to at least each of said front contact zone and said rear contact zone, respectively.

88. A ski according to claim 86 further comprising lateral angle elements on opposed sides of the ski, forming lower longitudinal edges of said ski.

89. A ski according to claim 88 wherein said lateral angle elements form surfaces which are generally perpendicular to said lower sliding surface and which are positioned adjacent said pair of longitudinally extending lateral surfaces.

90. A ski according to claim 86 wherein each of said pair of lateral surfaces is disposed t an angle, with respect to said lower sliding surface, which decreases continuously between said central zone and at least one of said front contact zone and said rear contact zone.

91. A ski according to claim 90 wherein said ski is symmetrical with respect to a vertical longitudinal median plane.

92. A ski according to claim 86 wherein said ski is asymmetrical with respect to a vertical longitudinal median plane.

93. A ski according to claim 86 wherein each of said pair of lateral surfaces is disposed at an angle, with respect to said lower sliding surface, which decreases continuously between said central zone and each of said front contact zone and said rear contact zone, respectively.

94. A ski according to claim 86 further comprising a front intermediate zone, wherein said angle at said front intermediate zone of said at least one of said pair of lateral surfaces with respect to said lower sliding surface is approximately 45°.

95. A ski according to claim 94 wherein said angle at said front contact zone of said at least one of said pair of lateral surfaces with respect to said lower sliding surface is approximately 0° to less than about 10°.

96. A ski according to claim 86 further comprising a rear intermediate zone, wherein said angle at said rear intermediate zone of said at least one of said pair of lateral surfaces with respect to said lower sliding surface is approximately 70°.

97. A ski according to claim 96 wherein said angle at said rear contact zone of said at least one of said pair of lateral surfaces with respect to said lower sliding surface is approximately 10° to 20°.

98. A ski according to claim 86 comprising a core, a casing, and a lower element, said casing and lower element surrounding said core.

99. A ski according to claim 98 wherein said casing comprises said upper surface and said pair of lateral surfaces.

100. A ski according to claim 99 wherein said casing comprises a shape and cross-section dimensions which continuously vary at least between said central zone and one of said front contact zone and said rear contact zone.

101. A ski according to claim 99 wherein said casing comprises a shape and cross-section dimensions which continuously vary between said central zone and each of said front contact zone and said rear contact zone, respectively.

102. A ski according to claim 81, wherein said pair of lateral surfaces are external surfaces of said ski.

103. A ski according to claim 81 wherein said lateral surfaces are convex.

104. A ski according to claim 81 wherein said lateral surfaces are concave.

105. A ski according to claim 81 wherein each of said pair of lateral surfaces slant toward the other from bottom to top.

* * * * *

UNITED STATES PATENT AND TRADEMARK OFFICE

CERTIFICATE OF CORRECTION

PATENT NO. : 5,108,124

DATED : April 28, 1992

INVENTOR(S) : Roger PASCAL et al.

It is certified that error appears in the above-identified patent and that said Letters Patent is hereby corrected as shown below:

On the cover page, item [75] inventorship should read ---Roger Pascal, Annecy le Vieux; Gilles Recher, Marc en Bareuil; and Jean-Luc Diard, Annecy le Vieux, all of France---.

On the cover page, item [30] May 23, 1986 [FR] France 86 07849--- should be inserted.

At column 9, line 36 (claim 8, line 2) "angel" should be changed to ---angle---.

At column 9, line 46 (claim 11, line 2) "angel" should be changed to ---angle---.

At column 16, line 10 (claim 90, line 2) "t an" should be changed to -- at an --.

Signed and Sealed this

Tenth Day of January, 1995

Bruce Lehman

*Attest:*

BRUCE LEHMAN

*Attesting Officer*

*Commissioner of Patents and Trademarks*